United States Patent [19]

Busker

[11] 4,189,344

[45] Feb. 19, 1980

[54] METHOD OF TEXTURING UNTEXTURED DRY SANITARY TISSUE WEB

[75] Inventor: Leroy H. Busker, Rockton, Ill.

[73] Assignee: Beloit Corporation, Beloit, Wis.

[21] Appl. No.: 962,633

[22] Filed: Nov. 21, 1978

Related U.S. Application Data

[63] Continuation-in-part of Ser. No. 800,737, May 26, 1977, abandoned.

[51] Int. Cl.[2] ..... D21F 11/00

[52] U.S. Cl. ..... 162/117; 162/197

[58] Field of Search ..... 264/280, 282, 283, 286, 264/287; 425/336, 369; 162/117, 197, 204, 205, 271, 362; 26/51

[56] References Cited

U.S. PATENT DOCUMENTS

| | | | |
|---|---|---|---|
| 2,216,803 | 10/1940 | Benda | 162/117 |
| 2,834,809 | 5/1958 | Schutte et al. | 162/117 |
| 3,161,557 | 12/1964 | Müller | 264/286 X |
| 3,203,850 | 8/1965 | McCarty | 264/283 X |
| 3,466,358 | 9/1969 | Muller | 264/287 |
| 3,597,299 | 8/1971 | Thomas et al. | 264/282 X |
| 3,608,047 | 9/1971 | Wiggins | 264/286 |
| 3,817,827 | 6/1974 | Benz | 264/282 X |
| 3,849,526 | 11/1974 | Muller et al. | 264/287 |

FOREIGN PATENT DOCUMENTS

| | | | |
|---|---|---|---|
| 25110 | of 1908 | United Kingdom | 264/286 |

*Primary Examiner*—Richard V. Fisher

*Attorney, Agent, or Firm*—Hill, Van Santen, Steadman, Chiara & Simpson

[57] ABSTRACT

Softness and bulk are imparted to untextured dry sanitary tissue sheet web by advancing it under ordinary support point tension through the nip of spaced grooved rotary texturing rolls having complementary partially interdigitated texturing ribs acting on both sides of the web with progressive wave-stretch texturing deformation of the web to release the hydrogen bonds between some of the fibers in the network of fibers in the web without breaking the fibers, and while maintaining the elasticity of the web.

10 Claims, 6 Drawing Figures

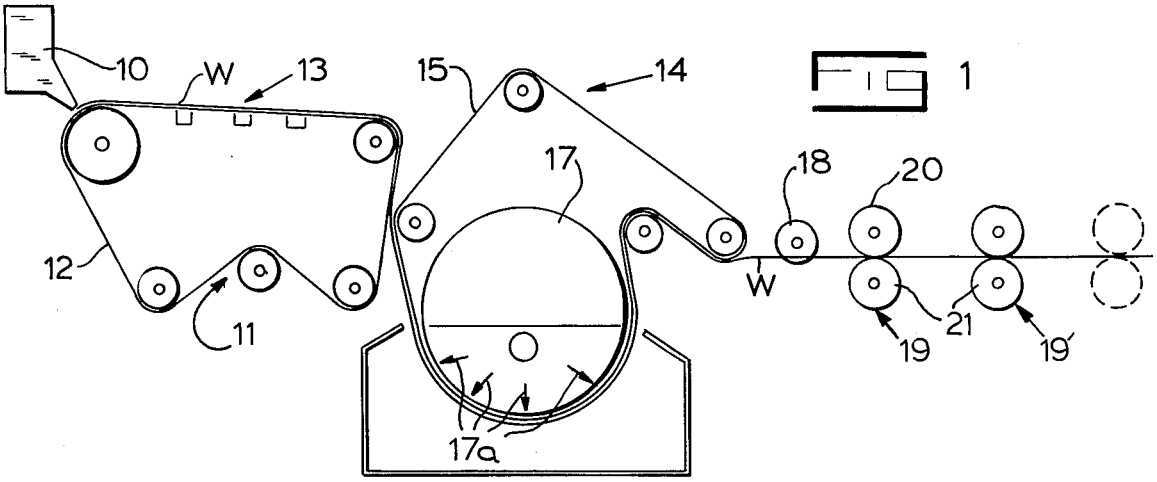
FIG 1
FIG 2
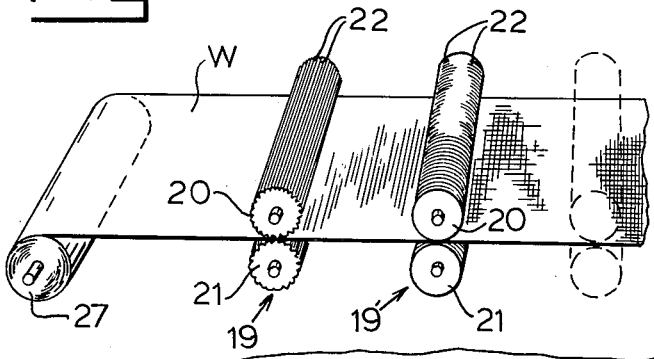
FIG 4
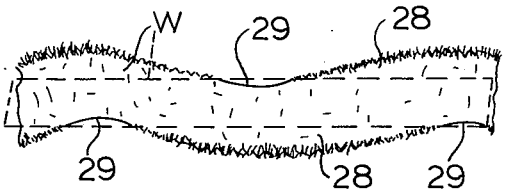
FIG 3
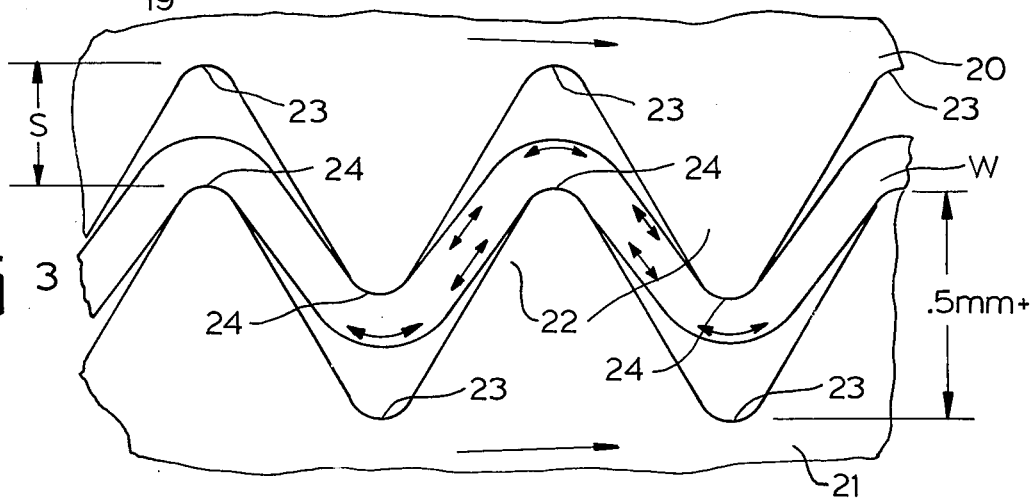
FIG 5
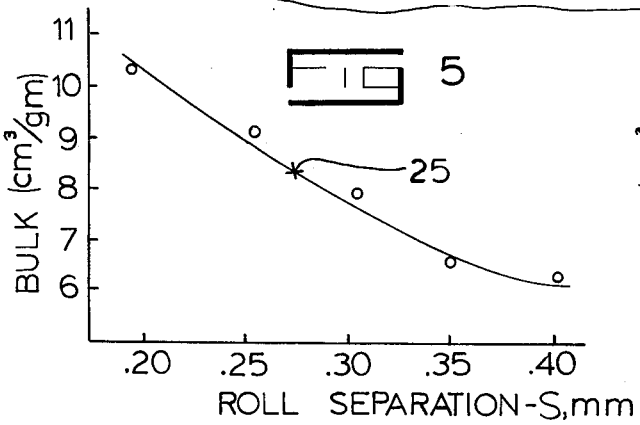
FIG 6
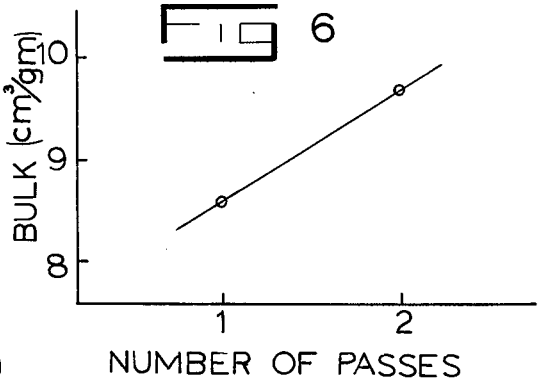

METHOD OF TEXTURING UNTEXTURED DRY SANITARY TISSUE WEB

This application is a continuation-in-part of my copending application Ser. No. 800,737 filed May 26, 1977, now abandoned.

The present invention relates to a method of texturing untextured dry tissue web, and in particular is directed to producing bulk and softness in the dry tissue web sheet.

Heretofore texturing of sanitary tissue web has generally been effected in connection with a Yankee dryer which is a large and costly high pressure steam vessel in the form of a drum on the periphery of which the web is dried. Bulk and softness in the tissue sheet is produced by creping, that is scraping the slightly adhered sheet from the Yankee roll surface by means of a doctor blade. Inasmuch as the adhesion of the tissue sheet to the Yankee drum surface is intimately associated with the drying process, the drying and creping are inseparable functions on the Yankee dryer drum.

Alternatively, some bulkiness may be produced in the tissue sheet by passing heated air through the tissue sheet, referred to as through-drying which is very satisfactory for drying the tissue in lieu of mechanical pressing. Such through-drying, as well as other tissue drying methods suffer from the limitation that there is no built in generation of bulk or softness equivalent to the process of creping from the Yankee dryer. As an order of magnitude estimate, a through-dryer tissue sheet may have only $\frac{1}{3}$ to $\frac{1}{2}$ the bulk of a tissue sheet creped from a Yankee dryer.

An important object of the present invention is to attain good bulk and softness generation in sanitary tissue sheet, avoiding the need for and great cost of a Yankee dryer and permitting drying of the sheet to be effected by methods alternative to Yankee dryer, such as through-drying.

A method embodying principles of the invention comprises producing bulky, soft sanitary tissue by providing in a continuous strip a low bulk dry untextured tissue sheet web of about 0.115 mm thickness from a water slurry of tissue quality cellulose fibers hydrogen bonded by drying of the web to from about 85% to 97% dry condition, providing cooperating grooved rotary texturing rolls each of which has generally radially projecting texturing ribs separated by grooves, the ribs on each of the rolls being the same and having from 4 to 30 equally spaced ribs per centimeter, measured across the ribs, each rib having a line contact crest, orienting said rolls in nip relation with the texturing ribs and grooves of each roll partially interdigitated with the ribs and grooves of the other of the rolls, and with the spacing between the partially interdigitated ribs greater than the thickness of said web, guiding said dry web under running tension through the rib and groove nip of said rolls, effecting longitudinal running of said dry web and rotation of said rolls at a common speed, thrusting said rib crests into the opposite faces of the running dry web with progressive wave-stretch deformation of the web areas engaged by the thrusting crests out of the original plane of the web, and thereby mechanically breaking the hydrogen bond of and partially loosening some of the fibers of the dry web and texturing and imparting desired tissue bulk and softness to the running dry web while retaining satisfactory web integrity, elasticity and breaking length characteristics in the textured web, and after said stretch deformation, releasing said web areas from said rib crests and permitting said web areas to return elastically toward said original plane of the web, whereby the loosened fibers at both faces of the web provide a fluffiness which imparts the desired bulk and softness to the textured dry web.

Other objects, features, and advantages of the invention will be readily apparent from the following description of certain representative embodiments thereof, taken in conjunction with the accompanying drawing although variations and modifications may be effected without departing from the spirit and scope of the novel concepts embodied in the disclosure and in which:

FIG. 1 is a schematic illustration demonstrating practice of the invention in association with a tissue web former and dryer.

FIG. 2 is a schematic illustration demonstrating practice of the invention on dry untextured web unwound from reels or logs as, for example, in a converting room.

FIG. 3 is a greatly enlarged schematic illustration of complementary partially interdigitated texturing ribs and grooves of the acting rotary texturing rolls demonstrating how the ribs thrust into the opposite faces of the running dry web with progressive wave-stretch deforming effect.

FIG. 4 is an enlarged fragmentary schematic illustration showing the web after it has been permitted to return elastically toward the original plane of the web following the texturing action by the texturing ribs.

FIG. 5 is a diagram showing bulk attainable by various roll separations; and

FIG. 6 is a diagram showing test results attained by the number of passes of a tissue web through the texturing rolls.

On reference to FIG. 1, a sanitary tissue sheet web W is produced by delivering tissue stock as a water slurry of tissue quality cellulose fibers from a headbox 10 to a former 11 comprising a foraminous belt 12 such as a fourdrinier wire which travels over or past a dewatering device such as a suction box 13. From the former 11 the still wet web is delivered to a through-dryer 14 which desirably comprises a porous dryer belt 15 arranged to pick the formed wet web from the former belt 12 and carry the wet web in drying relation about a substantial extent of the perimeter of a porous drying roll or drum 17. While on the drum heated drying air is driven through the belt 14 and the web as shown by the arrows 17*a*. By action of the dryer 14, the web is dried to a moisture content between 15% to 3% wet basis moisture content, i.e. from 85 to 97% dry condition, with a preferred dryness of about 8% wet basis moisture, i.e. 92% dry condition.

It will be understood that the term "dry" as applied to the web W, means an 85 to 97% dry condition of the web. In this condition the tissue web W has a relatively dense, firm texture, and although flexible feels hard and relatively smooth when touched. In this untextured state of the tissue sheet web, the fibers are hydrogen bonded to one another as a result of the drying to which the web has been subjected in the dryer. Under magnification few if any of the fibers appear unattached.

Beyond the dryer 14, the dry untextured tissue web W leaves the belt 15 and may be reeled into rolls for future converting. On the other hand, as depicted in FIG. 1, the web W may pass through a slitter 18 which divides the relatively wide web as formed into the desired narrower widths which may then be further processed and ultimately reeled into rolls such as toilet tissue rolls.

In order to provide the untextured dry tissue sheet web W with desired bulk and softness, in contrast to its relatively flat, hard, relatively smooth condition, the web is advanced through a mechanical texturing device 19 comprising in a simple and efficient form cooperating grooved rotary texturing rolls 20 and 21, of which there may be one or more sets to provide one or more texturing passes of the web through the nips of the rolls. Each of the texturing rolls 20 and 21 has generally radially projecting texturing ribs 22 (FIG. 3) separated by respective grooves 23. The ribs on each of the rolls are of the same configuration and there are provided from 4 to 30 equally spaced ribs per centimeter (20 to 75 per inch) measured across the ribs. Each of the ribs 22 is of generally triangular shape with a fairly sharp line contact crest 24. For practical reasons having to do primarily with fabricating the ribs 22, the crests 24 are provided with a slight radius. The ribs and grooves 22 and 23 may extend longitudinally relative to the axes of the rolls 20 and 21, or the ribs and grooves may extend circumferentially relative to the axes, as may be preferred. For some purposes, it may be desirable to provide for a plurality of successive texturing roll passes, such as indicated in FIGS. 1 and 2 wherein one set of rolls has the ribs running one way and the other set of rolls has the ribs running the other way. For example, the first pass rolls 19 may have the ribs and grooves extending longitudinally of the rolls, that is axially with respect to the axes of the rolls 20 and 21, and a succeeding roll pass 19' may have the ribs and grooves 22 and 23 extending circumferentially about the axes of the respective rolls. Especially where the ribs and grooves extend longitudinally along the roll perimeters, they may be of spiral screw thread form wherein the ribs on one of the rolls will be in the form of a right-hand thread and the ribs on the cooperating roll in the form of a left-hand thread so that with the rolls rotating in unison, the ribs 22 will uniformly partially interdigitate in spaced relation at the nip of the rolls.

It has been determined by experimentation that to attain the best results in producing desirable deformation of the dry tissue sheet passing through the nip of the ribbed rolls 20 and 21 to produce the desired bulk and softness, at least a 0.5 mm (0.020 inch) rib height and groove depth should be present having regard to a 0.115 mm calipered average thickness web. In addition, the degree or depth of spacing or separation S (FIG. 3) between the nips of the groove rolls 20 and 21, i.e. the spacing between the crests of the ribs 22 and the roots of the grooves 23, has been found to result in a fairly predictable bulkiness and softness in the resulting texture in the sheet web. For example, having reference to FIG. 5, maximum bulk $cm^3/gm$ is attained where the spacing between the ribs 20 and 21 is minimum. Where the caliper of untextured dry tissue web is about 0.115 mm the greatest bulkiness is attained where the space S at the nip of the rolls is at about 0.20 mm, and the bulkiness declines relatively sharply as indicated by the descending curve in FIG. 5 as the separation S is increased, for example by about 0.05 mm increments. As shown in FIG. 5, the rolls 20 and 21 may be spaced apart at the nip within a range of 0.20 mm to 0.40 mm, and the dry tissue web may be textured to a bulk within a range of 6 $cm^3/gm$ to about 10.5 $cm^3/gm$. It will be understood, of course, that the tear strength of the ultimately textured sheet will be substantially proportionate to the severity of texturing treatment to which the dry web is subjected as a result of the spacing of the roll nip. Excellent results for toilet tissue are attained where the other parameters for the ribs and grooves are substantially as already described and the spacing S of the roll nip is about 0.275 mm, and wherein the attained textured bulk is substantially as indicated at the 0.25 mm point on the curve in FIG. 5, namely, about 8.5 $cm^3/gm$ in one pass through the rolls 20 and 21.

Tension of the web W as it passes through the texturing nip of the rolls 20 and 21 need be no greater than normal support point to support point travelling tension of the web, in other words, tension necessary to prevent undesirable sagging of the web between running support points, that is the point at which the web leaves either the dryer as in FIG. 1 or a supply roll 27 in FIG. 2 and a further processing or reeling apparatus having suitable driving means at the end of downstream travel of the web, such apparatus being conventional and therefore not shown herein. By way of example, the tension in the web between its running support points as a result of web weight and controlled reeling or other pull may generally be not in excess of 0.09 kN/m(½ PLI). Suitable conventional means (not shown) may be provided for driving the rolls 20 and 21 at a common speed with the running speed of the web W.

Where greater bulk is desired, the dry tissue web W may be advanced through a plurality of texturing roll passes, two such passes being shown in FIGS. 1 and 2 and a third indicated as optional only if even greater bulk is desired. By way of example reference is made to FIG. 6 showing that the bulk rate attained is according to a straight line ascending curve as the web progresses through each successive pass. Thus, where a bulk of about 8.5 $cm^3/gm$ may be expected in one pass, the bulk rate becomes about 9.5 $cm^3/gm$ in a second pass having substantially the same texturing roll nip parameters. By advancing the web through a plurality of such texturing passes, loss in strength is minimized as compared with applying too severe texturing treatment in one pass.

Where it is preferred to effect texturing in the converting room of a plant, rather than as a continuous process following the slitter after the dryer of a papermaking machine installation, the arrangement shown in FIG. 2 may be employed. In this mode, the untextured dry tissue web is reeled into rolls or logs 27, one of which is depicted, and from which the web W is advanced through one or more sets of the texturing rolls 20, 21 having characteristics as already described. Beyond the texturing rolls, the textured web is advanced to other converting operations such as rolling into tissue rolls and wrapping, and the like.

By way of illustrating comparatively the results attained by texturing of untextured dry tissue web in accordance with the present invention, in contrast to average textured tissue produced according to prior art technique such as Yankee dryer creping, reference may be had to the following chart:

| | Basis Weight $gm/m^2$ | Thickness (Caliper) mm | Bulk $cm^3/gm$ | Breaking Length,m | Softness Rating |
|---|---|---|---|---|---|
| Average properties of prior art tissue | 22.2 | .20 | 9 | 400 | 1 to 9 harsh to soft |
| Untextured dry tissue | 20 | .115 | 5.75 | 1957 | — |

-continued

| | Basis Weight gm/m² | Thickness (Caliper) mm | Bulk cm³/gm | Breaking Length,m | Softness Rating |
|---|---|---|---|---|---|
| Ribbed and grooved roll treated dry tissue | 20 | .17 | 8.5 | 377 | 4 |

As will be observed in this chart, when starting with an untextured dry tissue web which may have been produced by through-drying and having a basis weight of about 20 gm/m² as compared to prior art (e.g. Yankee dryer creped) tissue, the dry tissue web after treatment according to the present invention remains at substantially a basis weight of 20 gm/m². Where the calipered thickness of the untextured dry tissue web is about 0.115 mm, after treatment it calipers at about 0.17 mm in comparison to about a 0.20 mm thickness for the prior art tissue. However, where the prior art tissue has a bulk of 9 cm³/gm, the dry tissue web textured according to the present invention has a closely similar bulk of 8.5 cm³/gm. Also the comparative breaking length is closely approached in the textured dry tissue web as compared to the prior art tissue in that as shown the breaking length of the textured dry tissue web according to the present invention is reduced to only 377 m from 1957 m and which compares quite favorable with the 400 m breaking lengths of the prior art tissue. Finally, in the softness rating wherein the prior art tissue may rate from 1 to 9 that is from harsh to very soft, a softness rating of about 4 is attained by practice of the present invention.

It will thus be apparent that according to the present invention it is possible to start with a very low bulk dry sheet of tissue and produce a final bulk comparable to tissue produced by prior art techniques such as Yankee dryer and creping. Quite substantial economies in original equipment and production are attained by the present invention by the ability to transform untextured dry tissue web produced by the most economical method such as by through-drying and without any need for the costly Yankee dryer or creping technique. The textured tissue sheet has, nevertheless, comparable bulk, tear strength and softness to the more costly prior art tissue.

In FIG. 4, there is shown as may be best portrayed by line drawing, what has been observed under magnification as to the results of texturing the dry tissue web W according to the present invention. As a result of the progressive wave-stretch deformation of the web areas engaged by the thrusting crests 24 out of the original plane of the tensioned web, as depicted in FIG. 3, there has been a breaking of the hydrogen bond of and partial loosening of some of the fibers of the dry tissue web. This is apparently effected by the stretching of the limited areas of the web between the crests 24 of the texturing ribs 22, and also the stretching of the web adjacent its surface opposite the thrust from the rib peaks 24, substantially as indicated by stretch arrows in FIG. 3. The texturing wave-stretching deformation of the web areas is effected within the parameters described to retain satisfactory web integrity, i.e. freedom from tears, and elasticity and breaking length characteristics and at the same time imparting the desired tissue bulk and softness. After the stretch deformation between the texturing ribs 22, the treated areas of the web are released from the rib crests 24 and permitted to return elastically toward the original plane of the web. As observed in the large magnification illustration in FIG. 4, as compared to the original plane structure of the untextured web W depicted in dash outline for comparison, the textured web shows fairly uniform narrow, slightly humped, partially loosened fiber fluffiness areas 28 alternately on the opposite faces of the textured web and of a width about the same as the distance between the web wave crests in FIG. 3. The areas 28 are located between those much narrower intervening surface portions 29 of the web directly engaged by the rib crests 24. The portions 29 are without apparent web fiber loosening.

Because of the narrow spacing between the texturing ribs 22 relative to the web thickness, the overall appearance of the textured web which, as evident from FIG. 2 has been wave-stretch treated over its entire width, is smoothly uniform, and the extremely narrow crest indented portions 29 are not apparent until one examines the web under magnification or at least under critically located and adequate intensity of illumination. Upon calipering the textured dry web, the calipering tool will engage the oppositely extending fluffy areas 28 now representing the major bulk measurement faces expanded from the original flat untextured faces of the web W. Touch examination of the dry textured web demonstrates excellent softness and feeling of bulkiness.

Softness is apparently enhanced by lack of breakage of fibers in the texturing treatment. Since the length of fibers in typical tissue quality cellulose fibers is about 1 to 5 mm and the wave-stretch deformation of the dry web undergoing texturing treatment is less than 1 mm in the preferred arrangement, there may be some bending of the fibers without fiber breakage, but the stretching in the local areas is sufficient to cause hydrogen bond release between at least some of the fibers. As demonstrated by FIGS. 3 and 4, there is sufficient debonding of fibers to attain the desirable fluffiness to impart decreased overall thickness or bulk and softness to the sheet.

Throughout the processing of the dry tissue sheet web, no moisture is added, and if there is any frictional heating at the texturing roll nip, it is actually an asset in maintaining the dry condition of the web to attain optimum results.

After the texturing treatment of the web, the web is permitted to spring back or elastically recover from the texturing tooth deformation, and there is insignificant elongation or widening of the web as a result of the texturing treatment, but the fluffiness areas 28 are enhanced.

Dry tissue web treated according to the present invention may be employed either as toilet tissue, or facial tissue, depending upon requirements, with appropriate adjustment in the basis weight of the untextured dry tissue sheet web.

It will be understood that variations and modifications may be effected without departing from the spirit and scope of the novel concepts of this invention.

I claim as my invention:

1. A method of producing bulky, soft sanitary tissue, comprising:

providing in a continuous strip a low bulk dry untextured tissue sheet web of about 0.115 mm thickness from a water slurry of tissue quality cellulose fibers hydrogen bonded by drying of the web to from about 85% to 97% dry condition;

providing cooperating grooved rotary texturing rolls each of which has generally radially projecting texturing ribs separated by grooves, the ribs on each of the rolls being the same and having from 4 to 30 equally spaced ribs per centimeter measured across the ribs, each rib being of generally triangular shape with a line contact crest;

orienting said rolls in nip relation with the texturing ribs and grooves of each roll partially interdigitated with the ribs and grooves of the other of the rolls, and with the spacing between the partially interdigitated ribs greater than the thickness of said web;

guiding said dry web under running tension through the rib and groove nip of said rolls;

effecting longitudinal running of said dry web and rotation of said rolls at a common speed;

thrusting said rib crests into the opposite faces of the running dry web and effecting progressive wave-stretch deformation of the web areas engaged by the thrusting crests out of the original plane of the tensioned web, and thereby mechanically breaking the hydrogen bond of and partially loosensing some of the fibers of the dry web and texturing and imparting desired tissue bulk and softness to the running dry web while retaining satisfactory web integrity, and elasticity and breaking length characteristics in the textured web;

and after said stretch deformation releasing said web areas from said rib crests and permitting said web areas to return elastically toward said original plane of the web;

whereby, the loosened fibers at both faces of the web provide a fluffiness which imparts the desired bulk and softness to the textured dry web.

2. A method according to claim 1, comprising advancing the dry untextured tissue sheet web through a plurality of said grooved rotary texturing roll nips, and thereby increasing the bulk and softness in the resulting tissue sheet.

3. A method according to claim 1, comprising providing the texturing rolls with texturing ribs at least 0.5 mm in height and intervening grooves about 0.5 mm deep, and spacing the rolls apart at the nip within a range of 0.20 mm to 0.40 mm.

4. A method according to claim 1, comprising effecting the texturing to attain a bulk of about 8.5 $cm^3/gm$.

5. A method according to claim 1, comprising forming the untextured dry tissue web to a basis weight of 20 $gm/m^2$ and texturing the dry tissue web to a caliper thickness of about 0.17 mm, a bulk of about 8.5 $cm^3/gm$ and a breaking length of about 377 m with a softness rating of about 4.

6. A method according to claim 1, wherein the untextured dry tissue web is of a basis weight of about 20 $gm/m^2$, and texturing the dry tissue web to a bulk within a range of about 6 $cm^3/gm$ to about 10.5 $cm^3/gm$.

7. A method according to claim 1, comprising after advancing the untextured dry tissue web through the nip of said first mentioned set of grooved rotary texturing rolls, successively thereafter advancing the dry tissue web through the nip of a second set of grooved rotary texturing rolls having complementary substantially interdigitated texturing ribs and grooves, and thereby increasing the bulk of the dry textured web.

8. A method according to claim 1, comprising forming said texturing ribs on said texturing rolls to run axially on the perimeter of the rolls, and dry texturing said web entirely across its width.

9. A method according to claim 1, comprising forming said texturing rolls with said ribs circumferentially on the rolls, and dry texturing the web entirely across its width.

10. A method according to claim 1, comprising providing said texturing ribs on said texturing rolls to extend axially along the perimeters of the rolls, and providing texturing rolls having the same characteristics except that the texturing ribs extend circumferentially on the perimeters of the rolls, and treating the same web successively between the rolls having the ribs running axially and between the rolls having the ribs running circumferentially.

* * * * *